US011724724B2

(12) United States Patent
Nagrodsky et al.

(10) Patent No.: US 11,724,724 B2
(45) Date of Patent: Aug. 15, 2023

(54) SYSTEM FOR CONTROLLING VITAL WAYSIDE DEVICES OF A RAILWAY NETWORK, AND VITAL SWITCH FOR SUCH VITAL DEVICES

(71) Applicant: ALSTOM Transport Technologies, Saint-Ouen-sur-Seine (FR)

(72) Inventors: Nicholas Nagrodsky, Melbourne, FL (US); James Frisbie, Melbourne, VA (US); Richard Lawson, Melbourne Beach, FL (US); Chris Schuchmann, Melbourne, FL (US)

(73) Assignee: ALSTOM TRANSPORT TECHNOLOGIES, Saint-Ouen-sur-Seine (FR)

( * ) Notice: Subject to any disclaimer, the term of this patent is extended or adjusted under 35 U.S.C. 154(b) by 409 days.

(21) Appl. No.: 16/932,169

(22) Filed: Jul. 17, 2020

(65) Prior Publication Data

US 2022/0017127 A1 Jan. 20, 2022

(51) Int. Cl.
*B61L 1/18* (2006.01)

(52) U.S. Cl.
CPC ..... *B61L 1/18* (2013.01)

(58) Field of Classification Search
CPC .... B61L 1/18; B61L 1/181; B61L 5/12; B61L 5/18
See application file for complete search history.

(56) References Cited

U.S. PATENT DOCUMENTS

2012/0299652 A1* 11/2012 Lemonovich ..... H03F 3/217 330/251
2019/0071106 A1* 3/2019 Carlson ..... B61L 27/70

* cited by examiner

*Primary Examiner* — Robert J McCarry, Jr.
(74) *Attorney, Agent, or Firm* — Nixon & Vanderhye

(57) ABSTRACT

A system for controlling one or more vital wayside devices of a railway network, comprising one or more vital switches, each vital switch being comprised in or operatively connected to an associated device of the one or more vital wayside devices, and a controller which is configured to control the one or more vital wayside devices. The controller is connected to each of the one or more vital switches by means of at least one optical fiber cable and is configured to output one or more light command signals over the at least one optical fiber cable, and each vital switch is configured to switch from an open status to a closed status to provide power and ground to the associated vital wayside device upon receiving at least one corresponding light command signal outputted by the controller for commanding an action of the associated vital wayside device.

13 Claims, 7 Drawing Sheets

SYSTEM FOR CONTROLLING VITAL WAYSIDE DEVICES OF A RAILWAY NETWORK, AND VITAL SWITCH FOR SUCH VITAL DEVICES

TECHNICAL FIELD

The present disclosure concerns in general the field of controlling wayside devices and equipment of railway systems. More in particular, the present disclosure relates to a system for controlling operations of vital wayside devices, which are devised to perform determined tasks in a fail-safe manner within a railway network where they are installed, and to a vital switch suitable to be used in connections with such vital devices.

BACKGROUND OF THE DISCLOSURE

As known, in present railway systems, wayside locations are stationed along the roadway to house the equipment and cabling interconnections. Based on the complexity of the section of train tracks being controlled by a given location, these wayside locations can be quite large and complex, with hundreds to thousands of connection points and wires. In particular, interconnections and control of the various pieces of equipment are realized by means of copper cables, according to solutions, which entail some drawbacks. For example, copper wires require lightning protections or some form of transient protection, they produce and are susceptible to electromagnetic interferences since copper cablings act like antennas and may transmit/receive noise; further, these cables require a large physical footprint and are rather expensive.

These drawbacks are further amplified and result in additional issues when vital equipment is involved. Indeed, a vital or fail safe equipment is a device aimed at performing very important functionalities within a system architecture and for this reason such devices are properly conceived and operated in such a way that any malfunctioning affecting safety will cause the faulty equipment to revert to a state that is generally known to be safe. Examples of such vital or fails safe equipment used in railway systems are interlocking devices, level crossings, lights; for instance, in case or a fault involving a light, an assumed red signal is a type of safe status.

In view of their special characteristics, vital devices require additional and ad hoc measures; for example, proper vital trace spacing/creepage and clearance are required between sets of copper vital inputs and outputs to ensure that a short circuit will not occur between two pieces of equipment. What is more, each piece of vital equipment is usually controlled by an associated electromechanical vital suppliers relay, and wayside control locations can encompass a large number of vital relays, e.g. from tens to hundreds of vital relays. These relays are usually physically large and require DIN/rack mounting, they are rather expensive, they vary in impedance as well as in thresholds for turn on/turn off, they have analog thresholds and compatibility issues between different suppliers and, since they are based on mechanical components, they are subject to wear and hence require maintenance and/or replacement.

BRIEF DESCRIPTION OF THE INVENTION

Hence, it is evident that there is room and desire for improvements in the way devices, and in particular vital devices are controlled in a railway system.

The present disclosure is aimed at providing a solution to this end and, in one aspect, it provides a system for controlling one or more vital wayside devices of a railway network, comprising:

- one or more vital switches, each vital switch being comprised in or operatively connected to an associated device of said one or more vital wayside devices;
- a controller which is configured to control said one or more vital wayside devices, wherein said controller is connected to each of the one or more vital switches by means of at least one optical fiber cable and is configured to output one or more light command signals over said at least one optical fiber cable, and wherein each vital switch is configured to switch from an open status to a closed status to provide power and ground to the associated vital wayside device upon receiving at least one corresponding light command signal outputted by said controller for commanding an action of the associated vital wayside device.

In another aspect, the present disclosure provides a vital switch for a device of a railway control system, comprising an optical receiver adapted to receive at least one light command signal emitted by a controller, and a solid state switch which is configured to switch from an open status to a closed status to provide power and ground to said device upon receiving the at least one light command signal outputted by the controller.

BRIEF DESCRIPTION OF THE DRAWINGS

Detailed characteristics and advantages will become apparent from the description of some preferred but not exclusive exemplary embodiments a system according to the present disclosure, illustrated only by way of non-limitative examples with the accompanying drawings, wherein.

DETAILED DESCRIPTION OF THE DISCLOSURE

Figure 1:
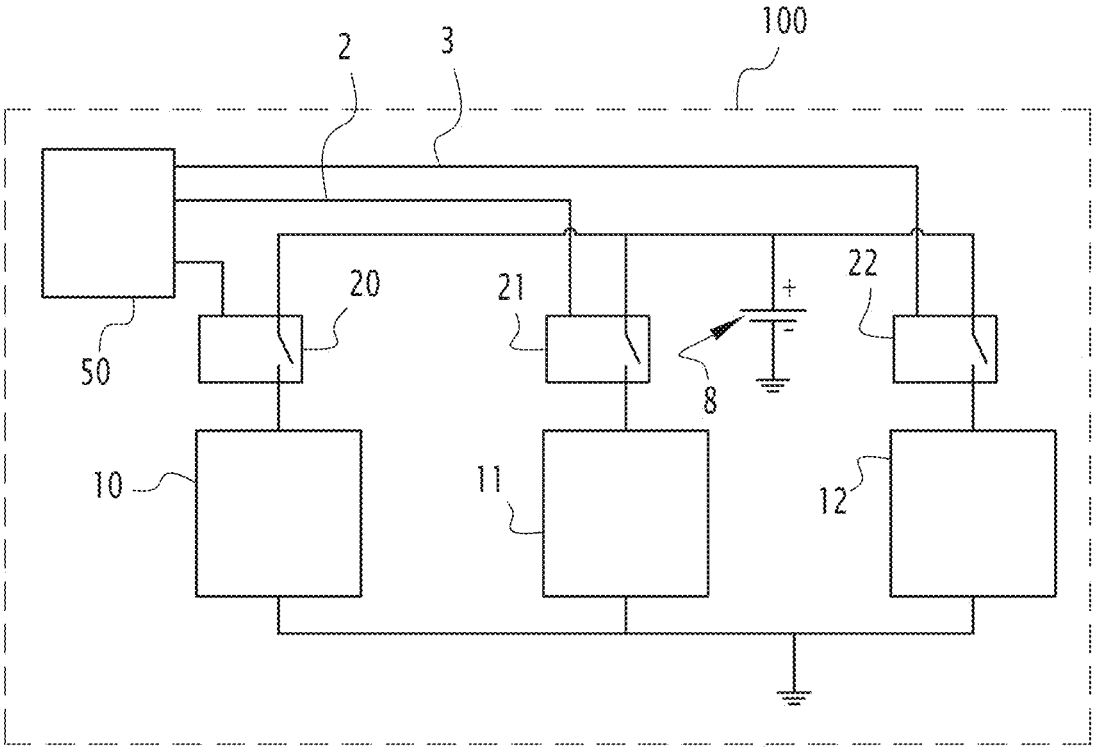
FIG. 1 is a block diagram schematically illustrating a first exemplary embodiment of a system for controlling one or more vital wayside devices of a railway network, according to the present disclosure.

It should be noted that in the detailed description that follows, identical or similar components, either from a structural and/or functional point of view, may have the same reference numerals, regardless of whether they are shown in different embodiments of the present disclosure. It should be also noted that in order to clearly and concisely describe the present disclosure, the drawings may not necessarily be to scale and certain features of the disclosure may be shown in somewhat schematic form.

Further, when the term "adapted" or "arranged" or "configured" or "shaped", is used herein while referring to any component as a whole, or to any part of a component, or to a combination of components, it has to be understood that it means and encompasses correspondingly either the structure, and/or configuration and/or form and/or positioning. In particular, for electronic and/or software means, each of the above listed terms means and encompasses electronic circuits or parts thereof, as well as stored, embedded or running software codes and/or routines, algorithms, or complete programs, suitably designed for achieving the technical result and/or the functional performances for which such means are devised.

In addition, when the term "substantial" or "substantially" is used herein, it has to be understood as encompassing an actual variation of plus or minus 5% with respect to an indicated reference value, time or position.

Finally, in the following description and claims, the numeral cardinals first, second, third, etc. . . . , will be used only for the sake of clarity of description and in no way they should be understood as limiting for whatsoever reason; in particular, the indication of a component referred to for instance as the "third . . . " does not imply necessarily the presence or strict need of the preceding "first" or "second" ones, unless such presence is clearly evident for the correct functioning of the subject switch machine, nor that the order should be the one described in the illustrated exemplary embodiment(s).

Figure 2:
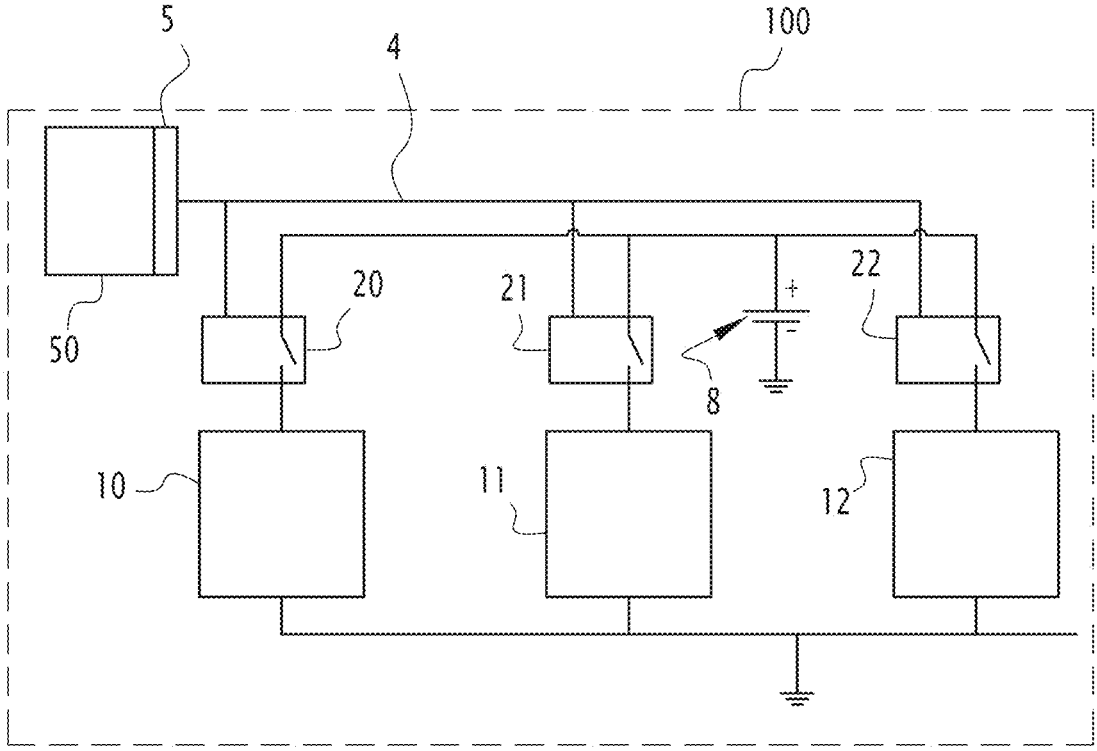
FIG. 2 is a block diagram schematically illustrating a second exemplary embodiment of a system for controlling one or more vital wayside vital devices of a railway network, according to the present disclosure.

A system for controlling one or more wayside devices, in particular vital devices, which are installed in a railway network, is illustrated in FIGS. 1 and 2 and therein indicated by the overall reference number 100. For ease of illustration, in FIGS. 1 and 2 there are illustrated only three vital devices 10, 11, 12, which can be constituted each for example by a cross level, a light signal, an interlocking et cetera; clearly, any suitable number and type of vital wayside devices is encompassed and can be controlled by the control system 100 according to the present disclosure.

The control system 100 comprises or more vital switches, each vital switch being comprised in or operatively connected to an associated vital wayside device; in particular, in the exemplary embodiment illustrated in FIG. 1, there are provided three vital switches, indicated by the corresponding reference numbers 20, 21, 22, which are associated each with a respective vital wayside device 10, 11, 12.

The control system 100 further comprises a controller 50 which is configured to control each of the one or more wayside vital devices 10, 11, 12.

Conveniently, in the system 100 the controller 50 is connected to each of the one or more vital switches 20, 21 and 22, by means of at least one optical fiber cable and is configured to output one or more light command signals over the at least one optical fiber cable; correspondingly, each vital switch 20, 21 and 22 is configured to switch from an open to a closed operative status to provide power and ground to the associated device 10, 11, 12 upon receiving at least one corresponding light command signal which has been outputted by the controller 50 for the specific vital switch 20 or 21 or 22. In this way, the vital wayside device 10 or 11 or 12 associated to the vital switch which received the light command signal performs a needed function, for example switching from green to red, or closing a crossing level.

The system 100 comprises also one or more power sources, in particular DC power sources, for providing the needed power; in the embodiments illustrated in FIGS. 1 and 2, there is shown only one power source, schematically represented by the battery 8; clearly, and as those skilled in the art would easily appreciate, depending on the applications and/or specific needs, there could be provided more and different power sources, each powering one or more associated vital switches and related vital devices According to the exemplary embodiment illustrated in FIG. 1, the system 100 comprises a plurality of optical fiber cables 1, 2, 3, each fiber cable connecting the controller 50 with one corresponding vital switch. For example, the first optical fiber 1 connects the controller 50 with the first vital switch 20, the second optical fiber connects the controller 50 with the second vital switch 21, and the third optical fiber 3 connects the controller 50 with the third vital switch 22. In this way, each optical fiber cable is arranged to transmit a respective light command signal selectively outputted by the controller 50 for each specific vital switch.

According to the exemplary embodiment illustrated in FIG. 2, the system 100 comprises only one optical fiber cable 4 connecting the controller 50 with all vital switches 20, 21, 22; in this case, the system 100 comprises a wavelength multiplexer 5, which can be included in the controller 50 or can be positioned along the single optical fiber 4; in this way, all vital switches receive the same overall light command signals outputted by the controller 50, but each vital switch only decodes the portion of wavelength assigned specifically to it.

The controller 50 can comprise or be constituted by any processor-based device, e.g. a microprocessor, microcontroller, a microcomputer, a programmable logic controller, an application specific integrated circuit, or any other programmable circuit, of a type commercially available, suitably programmed and provided to the extent necessary with circuitry, in order to perform the innovative functionalities devised for the system 100 according to the present disclosure.

Figure 3:
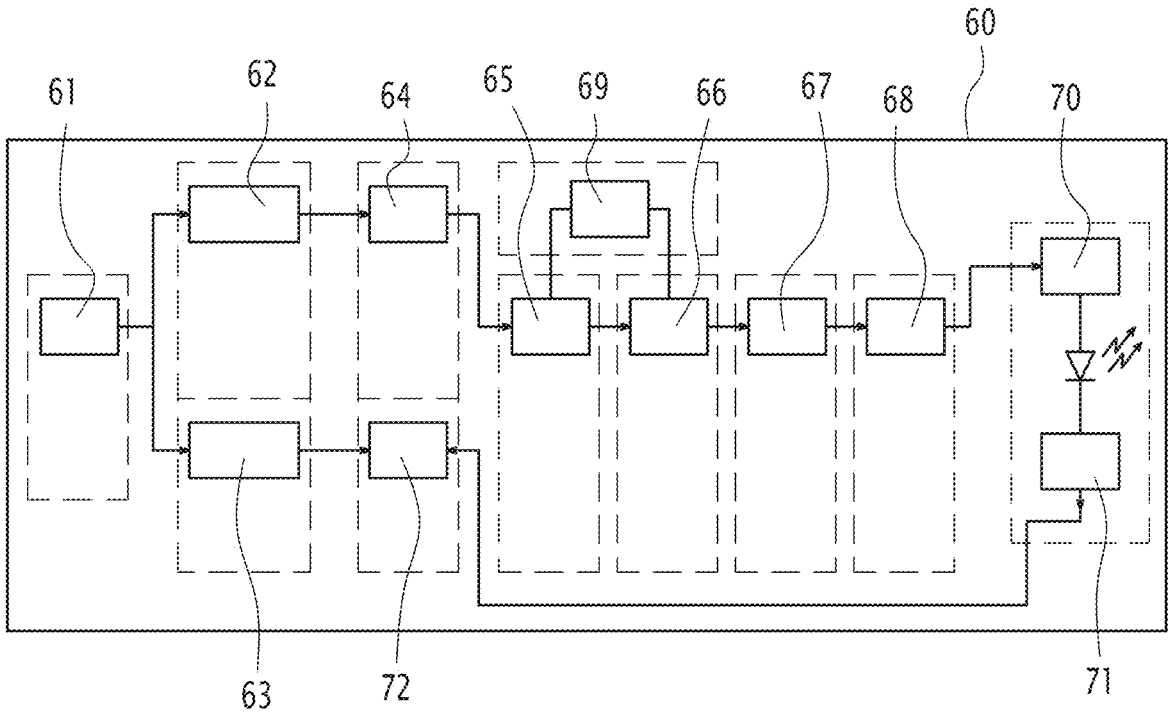
FIG. 3 is a block diagram schematically illustrating an example of an optical transmitter which can be used in the system of FIG. 1 or FIG. 2.

The system 100 according to the present disclosure comprises at least one optical transmitter, indicated in FIG. 3 by the reference number 60, which is part of or is operatively connected to the controller 50, and, for each vital switch 20, 21, 22, a corresponding optical receiver 80 which is part of or is operatively connected to an associated vital switch 20, 21 and 22.

Usefully, in the system 100 according to the present disclosure the optical transmitter 60 and each optical receiver 80 are arranged according to a two-out of-two (2oo2) architecture and the communication between them is realized using a vital protocol, which can be of any suitable type of available vital communication protocol, such as RP2000 and RP2009. In practice, in exchanging vital signals, two channels are used and both must agree in order to send/receive a signal vitally.

In particular, the optical transmitter 60 is adapted to generate, for each command to be outputted towards a corresponding vital switch, a first or reference light command signal and a safety signal; in turn, the optical transmitter is adapted to check consistency between the safety signal and a feedback signal. The optical receiver 80 of each vital switch 20, 21 and 22 is adapted to receive the first light command signal and to switch from an open to a closed status to provide power and ground to the associated wayside vital device.

More in details, the optical transmitter 60 comprises two independent processors/FPGA's that are each responsible for a portion of the signal being transmitted. According to the exemplary embodiment of FIG. 3, for instance a first Field Programmable Gate Array 62 (hereinafter first FPGA) is responsible for creating the unique signature to an optical LED, and a second Field Programmable Gate Array 63 (hereinafter second FPGA), which is independent from the first FPGA 62, is responsible for creating a return path for the LED used. Both are required to function and agree in order for the LED used to be actually energized. The first FPGA 62 makes sure that all inputs are correct and provides corresponding outputs to a power chopper block 64 which generates unique chopped signals that can not be recreated by failures. Each unique chopped signal is then fed into a drive circuit 65 for driving the received electrical signal into a light signal source via a light emitting device 66 capable of having high power, such as for example a laser comprising a super-luminescent LED (SLED). A light modulator 67 prevents spreading of the wavelength range of the light emitted by the source 66, and a following circuital block 68 is configured to keep the level of power to a controlled level over the transmitting fiber. The light signal emitted by the source 66 is also retroactively supplied to the drive circuit 65 via an optical monitor 69. The transmitter comprises also a LED 70, such as an ASLOED, for emitting light. The return path for the LED is created through a ground gate feedback signal 71 and a ground gate 72. According to this exemplary embodiment, the LED 70 is energized only if there is a consistency between the safety signal created by the second FPGA 63 and the ground gate feedback signal 71.

Figure 4:
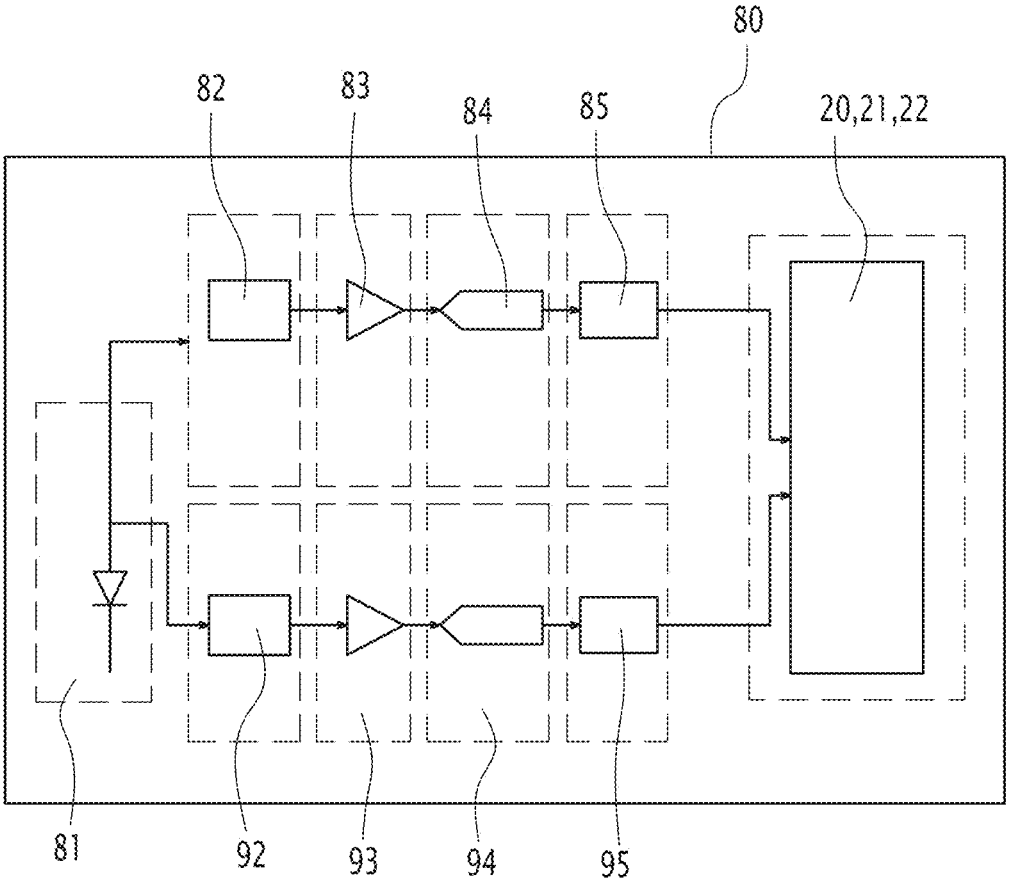
FIG. 4 is a block diagram schematically illustrating an example of an optical transmitter which can be used in the system of FIG. 1 or FIG. 2.

In turn, in the exemplary embodiment illustrated in FIG. 4, the optical receiver 80 comprises for instance a photodiode 81 converting the optical signals received into electrical current signals which are fed into two substantially identical processing branches. Each processing branch comprising for example in sequence: a filter 82 (respectively 92), for filtering out any undesired noise, an amplifier 83 (respectively 93) which is configured to amplify the current signal received and to convert it into a voltage signal; a converter 84 (respectively 94) for converting the analog voltage level received into a corresponding binary code; and a Field Programmable Gate Array 85 (respectively 95) which is configured to extract data signals and performs real time analyses. The two outputs coming from both processing branches are then fed into the associated vital switch 20 or 21 or 22, and only if they are consistent to each other, then the associated switch is properly activated to switch on.

According to a possible embodiment, the vital switches 20, 21, 22 comprise or are constituted each by a solid state switch which is associated to an external optical receiver, like the optical receiver 80 previously described; alternatively a vital switch, which can constitute the vital switches 20, 21, 22 used in the system 100, or which can be applied in any other suitable application, includes an optical receiver adapted to receive at least one light command signal emitted by a controller, like the controller 50, and a solid state switch which is configured to switch from an open status to a closed status to provide power and ground to an associated vital wayside device 10, 11, 12 upon receiving the at least one light command signal outputted by the controller 50.

Figure 5:
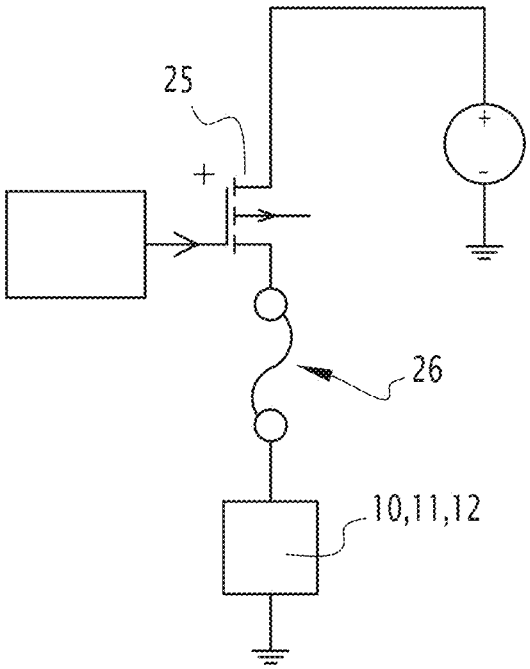
FIG. 5 is a view schematically showing a first exemplary embodiment of a vital switch usable in the system of FIG. 1 or FIG. 2.

A first possible embodiment of a solid state switch which can be used as or is comprised in a vital switch 20, 21, 22 is illustrated in FIG. 5. The illustrated solid state switch comprises a MOSFET 25 which is connected in series with a fuse 26 and receives at its gate the command signal transmitted via the relevant optical fiber cable. Usefully, the MOSFET 25 is configured to be driven in its linear region of functioning instead of in its saturation region. In this way, the MOSFET 25 acts like a power resistor with an impedance threshold. If the impedance of the MOSFET decreases below a threshold or short circuit, the fuse 26 opens the circuit thus preventing energy from passing into the vital wayside device 10, 11, 12 associated to the vital switch.

Figure 6:
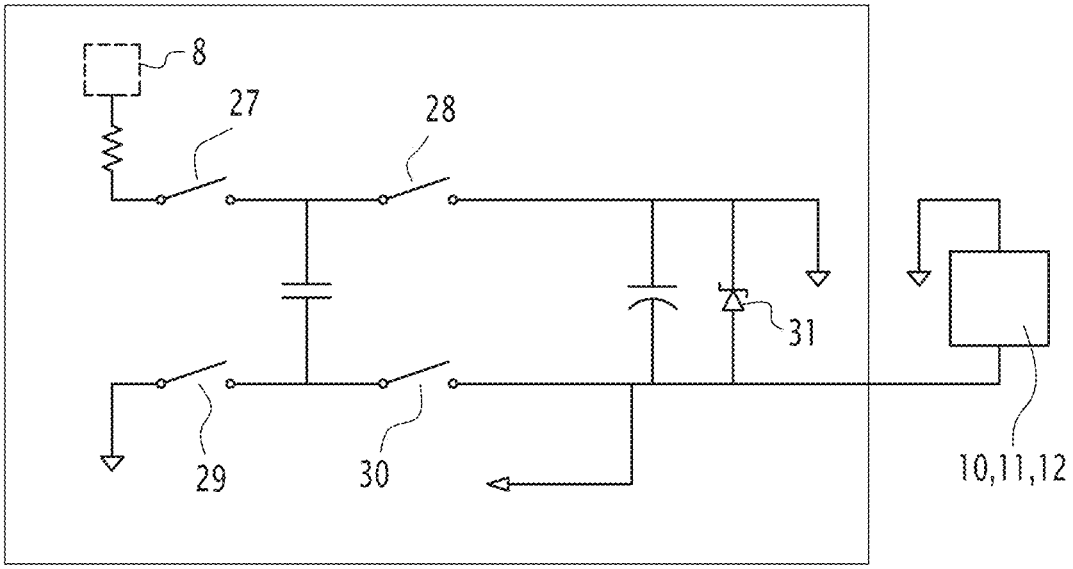
FIG. 6 is a view schematically showing a second exemplary embodiment of a vital switch usable in the system of FIG. 1 or FIG. 2.

In a second possible embodiment illustrated in FIG. 6, the solid state switch comprises an electronic charge pump. In particular, according to the example illustrated in FIG. 6, there are provided four switches 27, 28, 29 and 30, out of which two switches 27 and 28 are positioned in series to each other on a channel side after a resistor $R_{safety}$ which is connected to the battery 8, and the two other switches 29 and 30 are connected in series to each other on the other channel side. A first capacitor $C_{fly}$ is positioned along a branch connecting the two channel sides at points intermediate between the first and second switches 27-28 and the third and fourth switches 29-30, respectively. A second polarized capacitor $C_{hold}$ and a zener diode 31 are connected in parallel after the second switch 28 on one side and the fourth switch 30 on the other side. The resistor $R_{safety}$ limits the current in the circuit and has fail mode exclusions so that it will not decrease in resistance or short circuit, and allows more energy in the circuit. The capacitors may also have failure mode exclusions so that they will not increase in capacitance to limit the allowable energy storage that can be charged and passed to the load. These failure mode exclusions of the resistors and capacitors can be for example those allowed by the standards CENELEC EN50129 and AREMA 17.3.3.

According to this exemplary embodiment, a first clock signal and a second clock signal are sent by the controller 50 over the relevant fiber optical cable. These clock signals have a proper frequency suitable to switch the charge pump, have for example a 50% duty cycle and are 180° out of phase. Pulse signals A_pulse (delivered to 27 and 29) and B_pulse (delivered to 28 and 30) are derived from the clock signals via two corresponding PLDs not illustrated in the figures, which are for example part of the vital switch or alternatively they can be part the controller 50. For the proper working of the solid state vital switch, these two PLDs can be of any suitable type available in the market properly arranged to the extent necessary not to contain any logic that could generate a pulse signal in absence of a corresponding clock signal. Further, they have to be completely independent with respect to their corresponding clock and pulse signals related operations, and no direct communication or synchronization should exist since the only source of synchronization is represented by the clock signals properly generated by the controller 50 and suitably transmitted over the optical fiber cable. In this case, the vital switch is activated when the current flows in the correct polarity, and in particular in the example illustrated only if the positive (+) is connected to ground and a negative voltage is generated, which condition can occur if the A_pulse and the B_pulse are both dynamic with a frequency and a difference which are in the correct range. A feedback is sent back to the controller 50 if a negative voltage is not generated when should be, then the controller 50 negates the clock signals and reveals the failure triggering maintenance. If a clock is used for the PLDs, for example for filtering out and discriminating signals received from the fiber optical cable, its frequency should be preferably orders of magnitude greater than the frequency of the pulse signals. In turn, the resistence $R_{safety}$ is sized in such a way that the capacitor $C_{fly}$ is unable to charge when switched at a too high frequency; the capacitor $C_{fly}$ is properly sized to be unable to transfer sufficient energy when switched too slowly.

Figure 7:
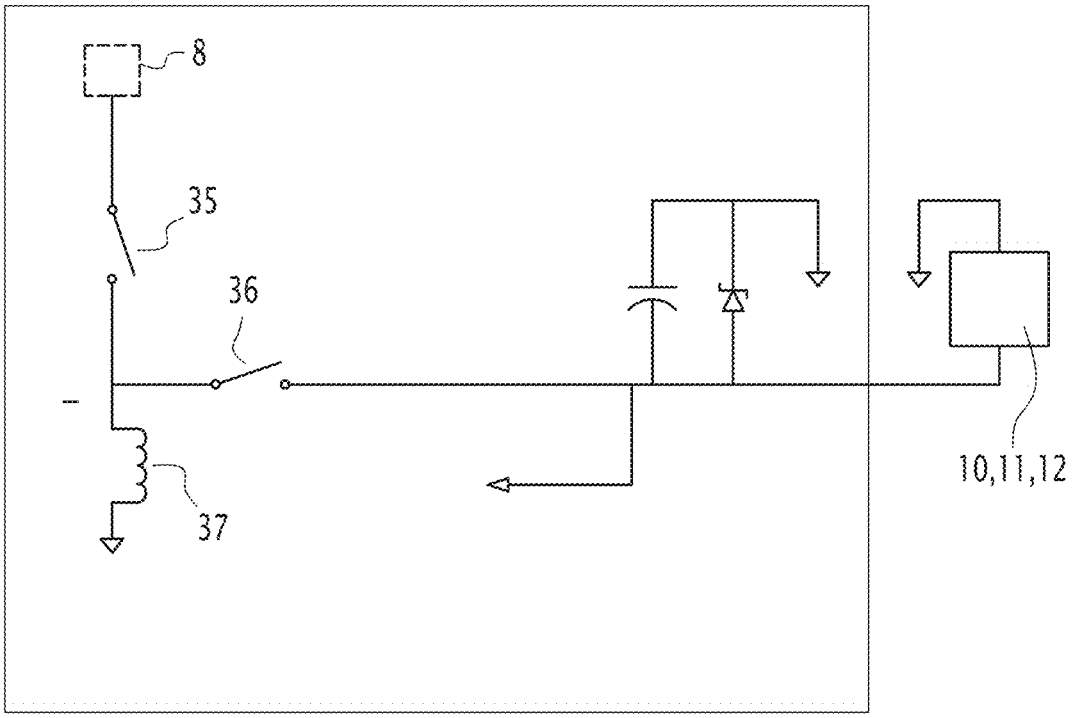
FIG. 7 is a view schematically showing a third exemplary embodiment of a vital switch usable in the system of FIG. 1 or FIG. 2.

In a third possible embodiment illustrated in FIG. 7, the solid state switch comprises a first switch 35 which is connected on one side to the battery 8 and on the other side to a second switch 36 and an inductor L. Further, similarly to the embodiment of FIG. 6, also in this case there are provided connected in parallel to each other and downward the second switch 36, the solid state switch comprises a polarized capacitor $C_{hold}$ and a Zener diode 31. The functioning in this case is similar to the embodiment of FIG. 4 with an A-pulse and a B_pulse which are derived, e.g. via the above mentioned PLDs, from two corresponding clock signals sent by the controller 50 over the relevant fiber optical cable and allow respectively to command the switch 35 and the switch 36. Also in this embodiment, these clock signals have a frequency for proper switching, e.g. 30 KHz, have for example a 50%, duty cycle and are 180° out of phase. Also in this case, the vital switch is activated when the current flows in the correct polarity, and in particular in the example illustrated only if the positive (+) is connected to ground and a negative voltage is generated, which condition can occur if the A_pulse and the B_pulse are both dynamic with a frequency and a difference which are in the correct range. A feedback is sent back to the controller 50 if a negative voltage is not generated when should be, then the controller 50 negates the clock signals and reveals the failure triggering maintenance. The inductor L is properly sized to be unable to energize the output when switched too quickly or too slowly.

Hence, it is evident that the system 100 according to the present disclosure, compared with prior art solutions, allows to reduce drastically the presence of copper wires used for cabling the various I/O between a controller and the vital wayside devices controlled by it. In this way, issues related to electromagnetic interferences and compatibilities, as well as threshold incompatibilities, are also substantially mitigated if not completely eliminated. The use of small optically controlled vital switches 20, 21, 22, and in particular of vital solid state switches allows to remove or substantially reduce the need for large and costly electro-mechanical relays and the presence of isolation transformers.

The system 100 and vital switch 20, 21 and 22 thus conceived are susceptible of modifications and variations, all of which are within the scope of the inventive concept as defined in particular by the appended claims; for example, some parts of the controller 50 may reside on the same electronic unit, or they can be realized as subparts of a same component or circuit of an electronic unit, or they can be placed remotely from each other and in operative communication there between; the transmitter 60 and receiver 80 can be realized according to many other suitable solutions; the vital switches used in the system 100 can be all of the same type, or it is possible to use different types of vital switches among those described in the exemplary embodiment of FIGS. 5, 6 and 7. All the details may furthermore be replaced with technically equivalent elements.

What is claimed is:

1. A system for controlling one or more vital wayside devices of a railway network, comprising:

one or more vital switches, each vital switch being comprised in or operatively connected to an associated device of said one or more vital wayside devices; and a controller which is configured to control said one or more vital wayside devices, wherein said controller is connected to each of the one or more vital switches by means of at least one optical fiber cable and is configured to output one or more light command signals over said at least one optical fiber cable, and wherein each vital switch is configured to switch from an open status to a closed status to provide power and ground to the associated vital wayside device upon receiving at least one corresponding light command signal outputted by said controller for commanding an action of the associated vital wayside device.

2. The system according to claim 1, further comprising:

a plurality of optical fiber cables, each fiber cable connecting the controller with one corresponding vital switch and being arranged to transmit a light command signal selectively outputted by the controller for said corresponding vital switch.

3. The system according to claim 1, further comprising:

a single optical fiber cable connecting the controller with each vital switch, and a multiplexer which is adapted to transmit, to each of the one or more vital switches, each light command signal outputted by the controller.

4. The system according to claim 1, wherein the controller comprises at least one optical transmitter adapted to generate, for each command to be outputted towards a corresponding vital switch, a first reference light command signal and a second safety signal, the second safety signal being configured to check the safe functioning of the transmitter.

5. The system according to claim 4, wherein each vital switch comprises or is operatively connected to at least one associated optical receiver which is adapted to receive said first reference light command signal and to switch from the open to said closed status to provide power and ground to the associated device.

6. The system according to claim 1, wherein said one or more vital switches each comprise a solid state switch.

7. The system according to claim 1, wherein said one or more vital switches comprise a MOSFET connected in series with a fuse.

8. The system according to claim 7, wherein said MOSFET is configured to be driven, based on a light command signal received from the controller, in a linear region of a functioning of said MOSFET.

9. The system according to claim 8, wherein said fuse is adapted to prevent power from passing into an associated vital wayside device if impedance of the MOSFET falls below a predefined threshold.

10. The system according to claim 1, wherein said one or more vital switches comprise an electronic charge pump.

11. The system according to claim 10, wherein said electronic charge pump comprises a first switch and a second switch which are connected in series to each other along a first circuital branch of a vital switch, a third switch and a fourth switch which are connected in series to each other along a second circuital branch of said vital switch, and a capacitor which is connected along a third circuital branch of said vital switch, said third circuital branch connecting a first point located along the first circuital branch between said first and second switches, with a second point located along the second circuital branch between said third and fourth switches.

12. The system according to claim 1, wherein said one or more vital switches comprise a first switch connected in series with an inductor along a first circuital branch of the vital switch, and a second switch which is located along a second circuital branch of the vital switch which is derived from the first circuital branch at a point intermediate between the first switch and the inductor.

13. A vital switch for a vital wayside device of a railway control system, comprising:

an optical receiver adapted to receive at least one light command signal emitted by a controller; and a solid state switch which is configured to switch from an open status to a closed status to provide power and ground to the vital wayside device upon receiving the at least one light command signal outputted by the controller.

* * * * *